US009475082B2

(12) United States Patent
Riney et al.

(10) Patent No.: US 9,475,082 B2
(45) Date of Patent: Oct. 25, 2016

(54) METHOD FOR DISPENSING AN ADHESIVE

(71) Applicant: Nordson Corporation, Westlake, OH (US)

(72) Inventors: John M. Riney, Buford, GA (US); Joel E. Saine, Dahlonega, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 14/794,205

(22) Filed: Jul. 8, 2015

(65) Prior Publication Data

US 2015/0306625 A1 Oct. 29, 2015

Related U.S. Application Data

(62) Division of application No. 14/068,946, filed on Oct. 31, 2013, now Pat. No. 9,108,214.

(51) Int. Cl.
*B67D 3/00* (2006.01)
*B05C 5/02* (2006.01)
(Continued)

(52) U.S. Cl.
CPC ..... *B05C 5/0229* (2013.01); *B05B 15/0233* (2013.01); *B05C 5/0225* (2013.01); *B05C 5/0237* (2013.01); *B05C 11/1028* (2013.01); *B05C 11/1034* (2013.01)

(58) Field of Classification Search
CPC ..... B05C 5/02; B05C 5/0225; B05B 1/28; B05B 1/30; B05B 1/3013; B05B 1/302; B05B 1/3026; B05B 1/3033; B05B 1/304; B05B 1/3046; B05B 1/306; B05B 15/02; F16K 23/00; C09J 5/00
USPC ..... 222/504, 559, 571; 251/62, 63, 63.5, 251/332, 333, 903
See application file for complete search history.

(56) References Cited

U.S. PATENT DOCUMENTS

| | | | | |
|---|---|---|---|---|
| 2,746,800 | A | 5/1956 | Voit | |
| 3,035,780 | A | 5/1962 | Peras | |
| 3,131,433 | A * | 5/1964 | Volland | B29C 45/52 198/659 |

(Continued)

FOREIGN PATENT DOCUMENTS

| | | | |
|---|---|---|---|
| EP | 1224034 | A2 | 7/2002 |
| EP | 2808088 | A1 | 12/2014 |
| GB | 2457220 | A | 8/2009 |

OTHER PUBLICATIONS

European Patent Office, International Search Report and Written Opinion in PCT Serial No. PCT/US2014/055803, Feb. 5, 2015.

*Primary Examiner* — Patrick M Buechner
(74) *Attorney, Agent, or Firm* — Baker & Hostetler LLP

(57) ABSTRACT

A dispensing module and method of dispensing an adhesive includes a dispenser body having a valve element and a nozzle. The nozzle includes a nozzle member, a sealing zone, and a valve seat. The nozzle member includes a liquid passageway having a bore, a cylindrical surface, a second converging surface, and a shoulder. The sealing zone is defined by the cylindrical surface and extends from the bore toward the shoulder and engages the valve element to close a first volume of the liquid passageway from the inlet. The valve seat is defined by the shoulder and the second converging surface and has a circular line of contact that engages the valve element to close a second volume of the liquid passageway from the inlet. The first volume reduces to the second volume as the valve element moves distally along the sealing zone for discharging the adhesive.

14 Claims, 10 Drawing Sheets

(51) Int. Cl.
*B05B 15/02* (2006.01)
*B05C 11/10* (2006.01)

(56) References Cited

U.S. PATENT DOCUMENTS

| | | | | | |
|---|---|---|---|---|---|
| 3,168,766 | A | | 2/1965 | Hornick | |
| 3,243,156 | A | | 3/1966 | Shoemaker | |
| 3,366,288 | A | | 1/1968 | Goldschein | |
| 3,415,427 | A | * | 12/1968 | Sharp | B22D 41/16 222/591 |
| 3,791,590 | A | * | 2/1974 | Dieter | B05B 1/28 222/501 |
| 3,911,173 | A | * | 10/1975 | Sprague, Jr. | A43D 25/183 12/142 R |
| 3,952,927 | A | | 4/1976 | Schaumburg et al. | |
| 3,958,730 | A | | 5/1976 | Caldwell | |
| 4,579,255 | A | | 4/1986 | Frates et al. | |
| 4,673,162 | A | * | 6/1987 | Lachmann | F16K 31/383 137/614.11 |
| 4,891,249 | A | * | 1/1990 | McIntyre | B05B 7/0475 118/315 |
| 5,094,276 | A | * | 3/1992 | Caputo | B01F 5/08 141/9 |
| 5,598,974 | A | | 2/1997 | Lewis et al. | |
| 5,683,544 | A | | 11/1997 | Kopp | |
| 5,873,528 | A | | 2/1999 | Lewis et al. | |
| 6,409,055 | B1 | * | 6/2002 | Officier | B67C 3/2608 222/559 |
| 6,986,739 | B2 | * | 1/2006 | Warren | A61B 5/0066 118/683 |
| 7,661,651 | B2 | * | 2/2010 | Kronholm | D21F 1/022 222/547 |
| 8,069,653 | B2 | | 12/2011 | Ganzer | |
| 8,333,307 | B2 | | 12/2012 | Chastine et al. | |
| 9,314,812 | B2 | * | 4/2016 | Clark | B05C 5/0225 |
| 2003/0132413 | A1 | | 7/2003 | Boecking | |
| 2004/0074994 | A1 | | 4/2004 | Ganzer | |
| 2005/0224513 | A1 | | 10/2005 | Strong et al. | |
| 2006/0286290 | A1 | | 12/2006 | Wanthal et al. | |
| 2009/0166386 | A1 | * | 7/2009 | Morand | B67C 3/281 222/559 |
| 2011/0114676 | A1 | | 5/2011 | Margheritis et al. | |
| 2012/0312838 | A1 | | 12/2012 | Clark et al. | |
| 2013/0105524 | A1 | * | 5/2013 | Saine | B05C 5/0237 222/504 |
| 2014/0120265 | A1 | * | 5/2014 | Larson | B05B 1/3013 427/372.2 |

* cited by examiner

METHOD FOR DISPENSING AN ADHESIVE

CROSS-REFERENCE TO RELATED APPLICATION

This application is a divisional of application Ser. No. 14/068,946, filed Oct. 31, 2013 (pending), the disclosure of which is hereby incorporated by reference herein.

TECHNICAL FIELD

The present invention relates generally to a dispensing module for dispensing viscous liquids and, more particularly, to a dispensing module for dispensing an adhesive.

BACKGROUND

Dispensing modules are commonly used to dispense viscous liquids, such as hot melt adhesives, in a variety of dispensing applications employed in the manufacture of products and in product packaging. Conventional dispensing modules are provided with either electrically actuated or electro-pneumatically actuated valve assemblies that regulate the flow and discharge of adhesive from the dispensing module. Typically, the valve assembly incorporates a valve element that is movable to a valve seat between open and closed positions. In the closed position, the valve member seals against the valve seat with a continuous line of contact to discontinue a flow of the adhesive from an outlet of the dispensing module. Cyclical movement of the valve element between the open and closed positions intermittently interrupts the flow to generate a pattern of adhesive on a receiving surface of the product or product packaging.

In many instances, the pattern includes one or more "beads" of the adhesive. The term "bead" generally refers to a continuous discharge of the adhesive, or any other viscous liquid, on the receiving surface with a desirable length, height, width, or other dimension. While the dimensions may vary given the particular application, the ability to repeatedly, accurately, and precisely initiate and terminate the bead provides a manufacturer with the best opportunity to efficiently position each bead on the receiving surface without waste. For example, there are many applications in which it is desirable or necessary to sharply cut off flow of the adhesive from the dispensing module to quickly and precisely terminate the bead on the receiving surface.

Unfortunately, known dispensing modules require a tradeoff between repeatability discharging adhesive and sharply cutting off the flow of adhesive. On one hand, many known dispenser modules capable of sharply cutting off the flow of adhesive tend to be more prone to "clogging," in which the adhesive blocks the outlet from the further discharge of adhesive. Clogged dispensing modules must be manually cleaned or replaced, resulting in equipment downtime and significant labor and replacement costs to the manufacturer. On the other hand, many known dispenser modules capable of physically displacing clogged adhesive tend to be more prone to a bead "tailing effect" or "stringing," in which the flow of adhesive gradually reduces to terminate the bead. The "tailing effect" refers to the bead tapering to termination due to the more gradual flow reduction, whereas "stringing" refers to wasted adhesive that discharges from the dispensing module but fails to reach the bead. For this reason, manufacturers carefully consider these various tradeoffs when selecting a dispensing module for a particular application.

There is a need for a dispensing module and method for dispensing a viscous liquid that sharply cuts off the flow of viscous liquid and inhibits clogging while addressing issues such as those discussed above.

SUMMARY

An exemplary embodiment of a dispensing module for dispensing adhesive comprises a dispenser body and a nozzle connected to the dispenser body. The dispenser body has a liquid supply passageway and a valve element. The valve element includes a first valve surface and a second valve surface and moves from a proximal position to a distal position. The nozzle comprises a nozzle member, a sealing zone, and a valve seat.

The nozzle member includes an inlet, an outlet, and a liquid passageway extending from the inlet to the outlet. The liquid passageway is fluidly connected to the liquid supply passage and includes a bore extending toward the outlet and a cylindrical surface extending toward the outlet. In addition, the liquid passageway includes a second converging surface tapering conically toward the outlet and a shoulder positioned between the second converging surface and the cylindrical surface.

The sealing zone is defined by the cylindrical surface and extends from an intersection between the cylindrical surface and the bore toward the shoulder. The sealing zone also has a seal diameter sized to engage the first valve surface of the valve element moving from the proximal position to the distal position. The sealing zone and valve element close a first volume of the liquid passageway from the inlet.

The valve seat is defined by an intersection between the shoulder and the bore as a circular line of contact. The circular line of contact is sized such that the valve seat engages the second valve surface of the valve element in the distal position. The valve seat and valve element close a second volume of the liquid passageway from the inlet. As such, the first volume of the passageway reduces to the second volume as the valve element moves distally along the sealing zone for discharging a volume of adhesive from the outlet.

Another exemplary embodiment of a nozzle for a dispensing module comprises a nozzle member, a sealing zone, and a valve seat. The nozzle member includes an inlet, an outlet, and a liquid passageway extending from the inlet to the outlet. The liquid passageway is fluidly connected to the liquid supply passage and includes a bore extending toward the outlet and a cylindrical surface extending toward the outlet. In addition, the liquid passageway includes a second converging surface tapering conically toward the outlet and a shoulder positioned between the second converging surface and the cylindrical surface. The sealing zone is defined by the cylindrical surface and extends from an intersection between the cylindrical surface and the bore toward the shoulder. The sealing zone also has a seal diameter sized for sealing against a valve element and closing a first volume of the liquid passageway from the inlet. Furthermore, the valve seat is defined by an intersection between the shoulder and the second converging surface as a circular line of contact. The circular line of contact is sized for sealing against the valve element and closing a second volume of the liquid passageway from the inlet. As such, the first volume of the passageway reduces to the second volume along the sealing zone for discharging a volume of adhesive from the outlet.

In use, an adhesive bead is dispensed from a dispensing module having a nozzle with an inlet, an outlet, and liquid passageway extending therebetween. A method of dispensing the adhesive bead includes forcing a pressurized adhesive from the outlet with a valve element in a proximal position to discharge a first portion of the adhesive bead. The method also includes moving the valve element from the proximal position to a sealing zone and closing a first volume of the liquid passageway from the inlet to cease discharging the first portion of the adhesive bead. Furthermore, the method includes moving the valve element distally along the sealing zone toward a distal position and reducing the first volume of the liquid passageway to force additional adhesive from the outlet and discharge a second portion of the adhesive bead. In addition, the method includes engaging the valve element against a valve seat in the distal position to close a second volume of the liquid passageway from the inlet to cease discharging the second portion of the adhesive bead. The method further includes inserting at least a portion of a needle tip into a discharge passageway that defines the outlet for inhibiting clogging of the adhesive within the nozzle.

Various additional objectives, advantages, and features of the invention will be appreciated from a review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
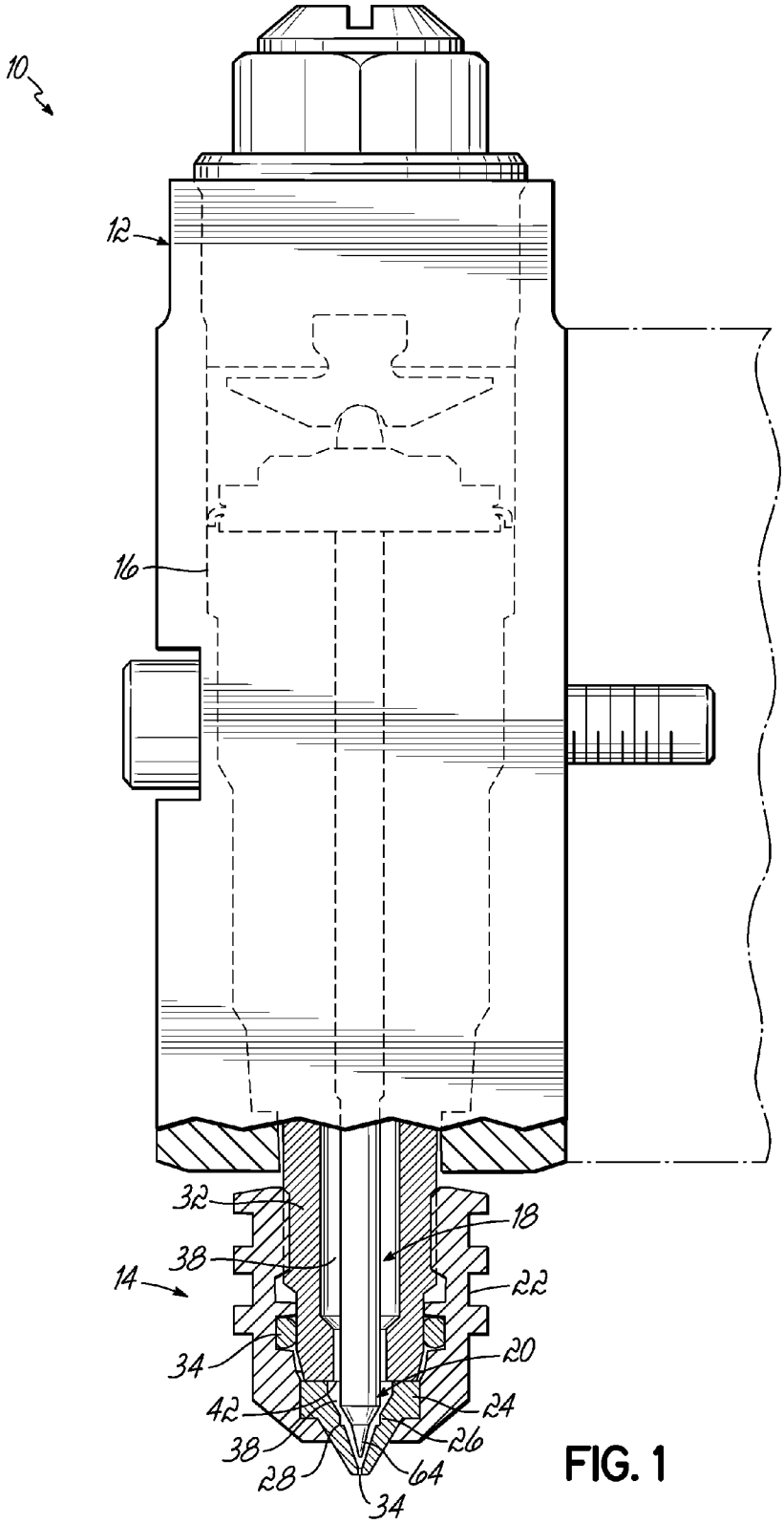
FIG. 1 is a sectional view of an embodiment of a dispensing module constructed in accordance with the invention.

FIG. 1 illustrates an exemplary embodiment of a dispensing module 10 for dispensing an adhesive or other viscous liquid. The dispensing module 10 includes a dispenser body 12 and a nozzle 14 coupled removably or detachably with the dispenser body 12. Generally, the dispenser body 12 may be any suitable dispenser body configured to provide a liquid flow to the nozzle 14. The dispenser body 12 also includes a bore 16 receiving a needle 18, or other valve element, mounted for reciprocating movement within dispenser body 12 between a distal closed position and proximal open position. With respect to the use of the terms "distal" and "proximal," it will be appreciated that such directions are intended to describe relative locations along exemplary embodiments of the dispensing module 10. It is not intended that the terms "distal" and "proximal" limit the invention to any of the exemplary embodiments described herein.

Figure 2A:
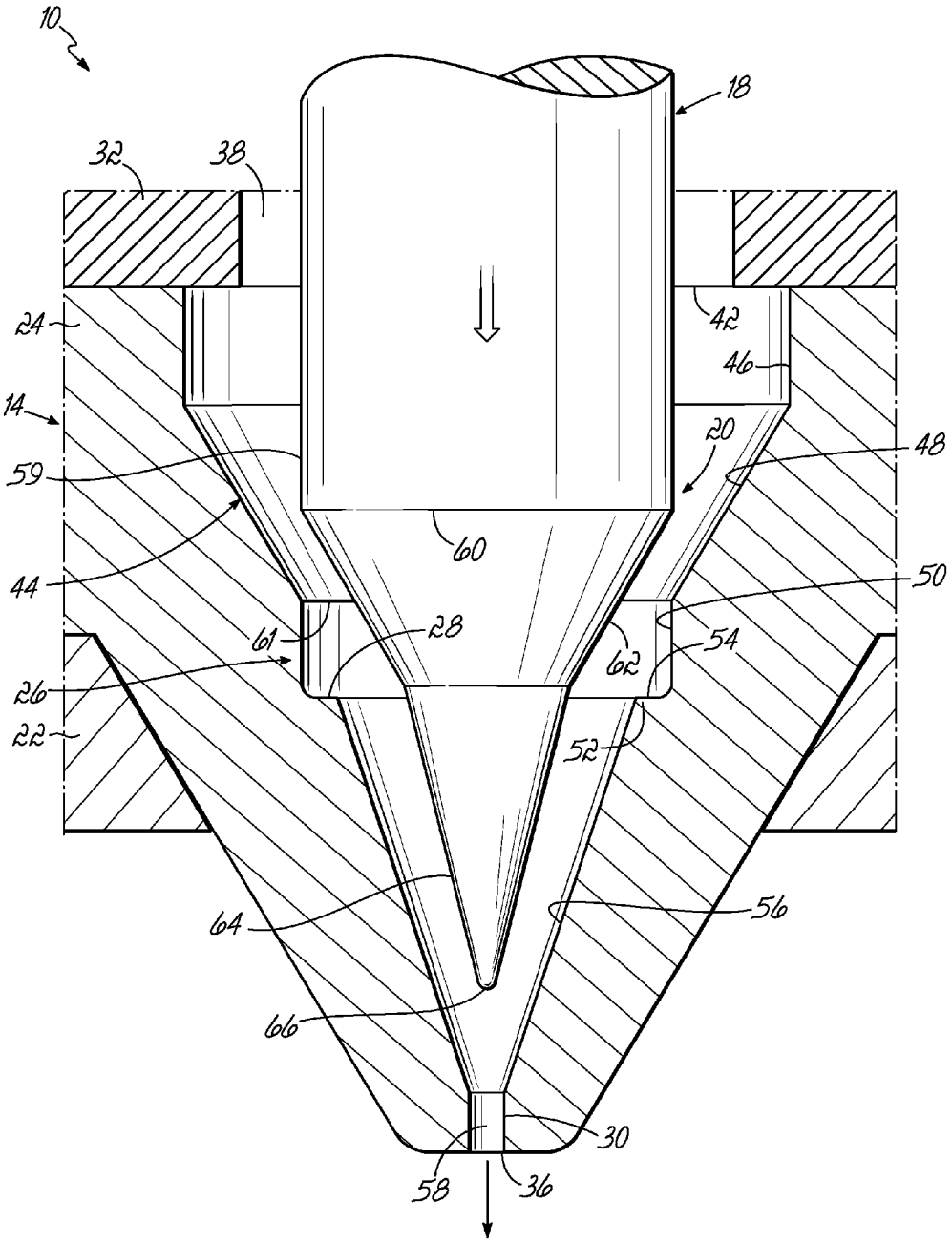
FIG. 2A is an enlarged view of the dispensing module of FIG. 1 having a valve element in a proximal open position.

With respect to FIG. 1 and FIG. 2A, the needle 18 is an elongated shaft having a needle tip 20 proximate to the nozzle 14. More particularly, the needle 18 extends through a needle guide (not shown) that constrains the needle 18 to perform substantially linear reciprocation relative to dispenser body 12 with an insignificant amount of lateral displacement or deflection of its elongated shaft. The nozzle 14 includes a nozzle body 22 and a nozzle insert 24 positioned within the nozzle body 22 that carries a sealing zone 26 and valve seat 28, described below in greater detail. The needle tip 20 of needle 18 selectively engages the sealing zone 26 and valve seat 28, in association with the axial movement of the needle 18, for controlling the flow of adhesive through a discharge passageway 30 extending distally from the valve seat 28. The adhesive is repeatedly discharged from an outlet 36 of the discharge passageway 30 for dispensing a bead of adhesive precisely and without undue clogging, tailing, or stringing. As described herein, the term "bead" generally refers to a continuous discharge of the adhesive, or any other viscous liquid, on a receiving surface with a desirable length, height, width, or other dimension. In addition, the term "tailing" refers to the bead tapering to termination, whereas the term "stringing" refers to wasted adhesive that discharges from the dispensing module 10 but fails to reach the bead. According to the exemplary embodiment of the dispensing module 10, the dispenser body 12 and needle 18 are described in additional detail in U.S. Pat. No. 8,069,653, filed Oct. 16, 2002, assigned to the assignee of the present invention, and the disclosure of which is hereby incorporated by reference herein.

The needle 18 is in the proximal open position such that the inlet 42 openly communicates adhesive to the outlet 36. The dispenser body 12 further includes a nozzle adapter 32 inserted into the bore 16 to partially extend from the dispenser body 12. The nozzle adapter 32 is configured to mate with the nozzle body 22 for mechanically coupling or attaching the nozzle 14 with the dispenser body 12. An O-ring 34 provides a fluid seal between the nozzle adapter 32 and the nozzle body 22.

A liquid supply passage 38 extends through the dispenser body 12 along a length of the needle 18. The liquid supply passage 38 fluidly connects to an inlet 42 of a liquid passageway 44 within the nozzle 14. Accordingly, liquid adhesive flows through the liquid supply passage 38, the liquid passageway 44, and the discharge passageway 30, to be dispensed from the outlet 36 when the needle 18 is disengaged from valve seat 28. Accordingly, the nozzle 14 and the needle 18 collectively provide a dispensing valve for controlling the flow of adhesive from the outlet 36.

More particularly, as shown in FIG. 2A, the liquid passageway 44 is defined by a plurality of inner bores or surfaces within the nozzle insert 24. The nozzle insert 24 includes a proximal, first cylindrical surface 46 defining the inlet 42 that extends to a proximal bore 48. More particularly, the bore 48 is in the form of a first converging surface, such as a first frustoconical surface. The nozzle insert 24 also includes a sealing cylindrical surface 50 extending from the bore 48 to a shoulder 52 carrying the valve seat 28. The shoulder 52 has a planar annular surface 54 facing toward the nozzle insert 24. The valve seat 28 is further defined by an intersection between the shoulder 52 and a distal, second converging surface 56. More particularly, the second converging surface 56 is in the form of a second frustoconical surface. Accordingly, the valve seat 28 provides a sharp circumferential edge that defines a circular line of contact with the needle tip 20. It will be appreciated that the term "circular line of contact" may refer to a circular line of generally any width. For example, the circular line of contact may be a thin circular line having a relatively small amount of surface area or a thick circular line of contact having a relatively large amount of surface. According to an exemplary embodiment, the sharp circumferential edge defines a relatively thin circular line of contact.

The valve seat 28 is centered or coaxial with, and radially symmetric relative to the longitudinally extending needle 18 within the liquid passageway 44. The second converging surface 56 extends to the discharge passageway 30 having the outlet 36, which is defined by a distal, second cylindrical surface 58. The bore 48, in the form of the first converging surface, and the second converging surface 56 taper conically toward the outlet 36 with a given taper angled relative to the longitudinally extending needle 18. In contrast, the first and second cylindrical surfaces 46, 58 extend toward the outlet 36 generally parallel to the longitudinally extending needle 18.

The needle 18 includes a cylindrical valve surface 59 extending to the needle tip 20. An intersection of the cylindrical valve surface 59 and the needle tip 20 define a valve leading edge 60, whereas an intersection of the sealing cylindrical surface 50 and the bore 48 define a nozzle leading edge 61. The sealing cylindrical surface 50 of the liquid passageway 44 defines a sealing diameter sized to provide a sealing engagement with the cylindrical valve surface 59. As such, the valve leading edge 60 contacts and aligns with the nozzle leading edge 61 to define a first volume 70 (see FIG. 2B) of the liquid passageway 44 closed from the inlet 42.

Furthermore, the needle tip 20 includes a first frustoconical valve surface 62 and a second frustoconical valve surface 64. The first and second frustoconical valve surfaces 62, 64 form a compound angle and terminate at a blunt apex 66. A circumferential portion of the first frustoconical valve surface 62 contacts the valve seat 28 to create the thin circular line of contact, which provides a sealing engagement in the distal closed position that defines a second volume 72 (see FIG. 2C) of the liquid passageway 44 closed from the inlet 42. In other words, the needle 18 seals against the nozzle insert 24 and blocks the flow of adhesive moving along the liquid passageway 44 toward the outlet 36. Each of the first and second frustoconical valve surfaces 62, 64 and cylindrical valve surface 59 are centered along, and radially symmetric or coaxial about the needle 18.

Furthermore, the first frustoconical valve surface 62 tapers conically toward the apex 66 with a first included angle, whereas the second frustoconical valve surface 64 tapers conically toward the apex 66 with a second included angle smaller than the first included angle. According to an exemplary embodiment, the second included angle is smaller than the first included angle. The taper angle of the second converging surface 56 of the liquid passageway 44 is greater than or equal to the second included angle of the second frustoconical valve surface 64 such that a volume of a cavity 68 defined therebetween is reduced to minimize residual adhesive within the cavity 68. Also, at least a portion of the second frustoconical valve surface 64 and the apex 66 extend into the discharge passageway 30, proximate to the outlet 36, to inhibit clogging of adhesive in the distal closed position.

Figure 2B:
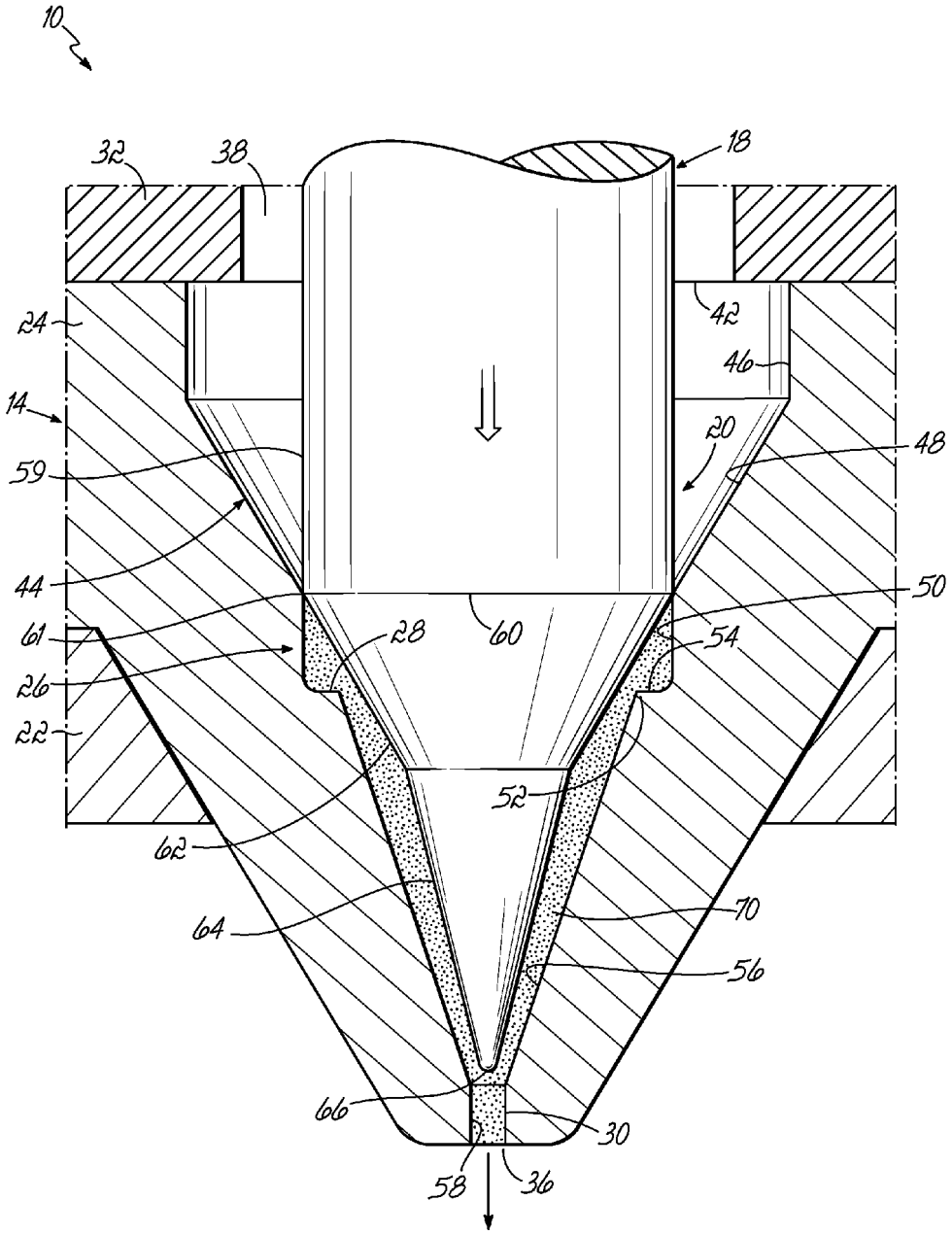
FIG. 2B is similar to FIG. 2A, but shows the valve element in a medial closed position.
Figure 2C:
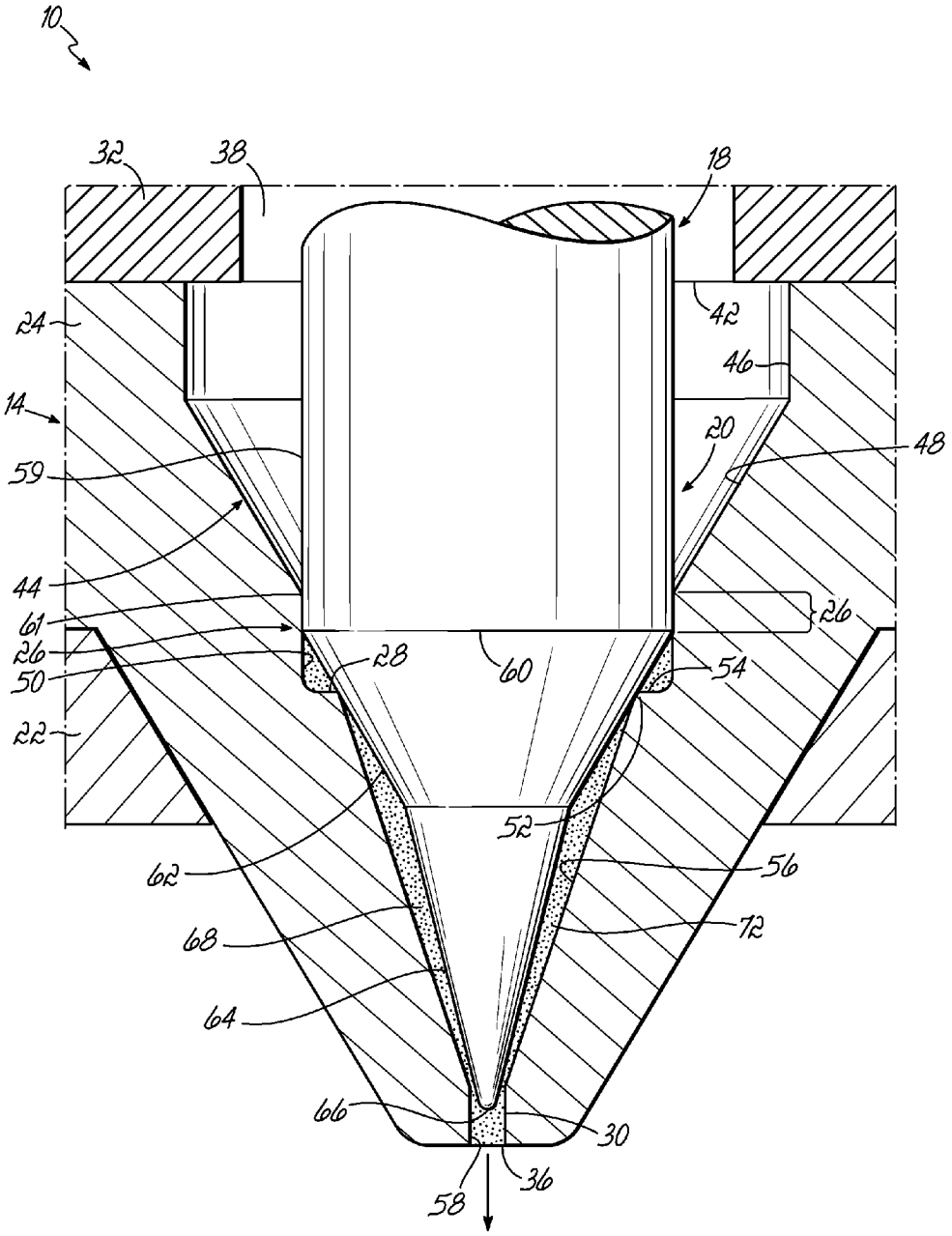
FIG. 2C is similar to FIG. 2B, but shows the valve element in the distal closed position.

With respect to FIG. 2B, the needle 18, while moving from the proximal open position toward the distal closed position, moves into a medial closed position in which the first volume 70 of the liquid passageway 44 is closed from the inlet 42. The first volume 70 is represented in FIG. 2B by a first remaining volume of adhesive located within the liquid passageway 44 distal of the alignment between the valve leading edge 60 and the nozzle leading edge 61. Of course, as shown in FIG. 2C, the needle 18 continues to move to the distal closed position where the second frustoconical valve surface 64 engages the valve seat 28. The second volume 72 is represented in FIG. 2C by a second remaining volume of adhesive located within the liquid passageway 44 distal of the valve leading edge 60 engaged against the sealing cylindrical surface 50.

The valve leading edge 60 moves distally beyond the nozzle leading edge 61 along the sealing cylindrical surface 50 as the needle 18 moves from the medial closed position to the distal closed position. Accordingly, the distance along the sealing cylindrical surface 50 that the valve leading edge 60 travels and further defines the sealing zone 26 along at least a portion of the sealing cylindrical surface 50 with the seal diameter. As the valve leading edge 60 moves distally along the sealing zone 26, the first volume 70 gradually reduces to the second volume 72 and the needle 18 positively displaces a differential volume of adhesive from the liquid passageway 44. The differential volume of the adhesive equates to the difference between the first remaining volume of adhesive 70 and the second remaining volume of adhesive 72.

Figure 3A:
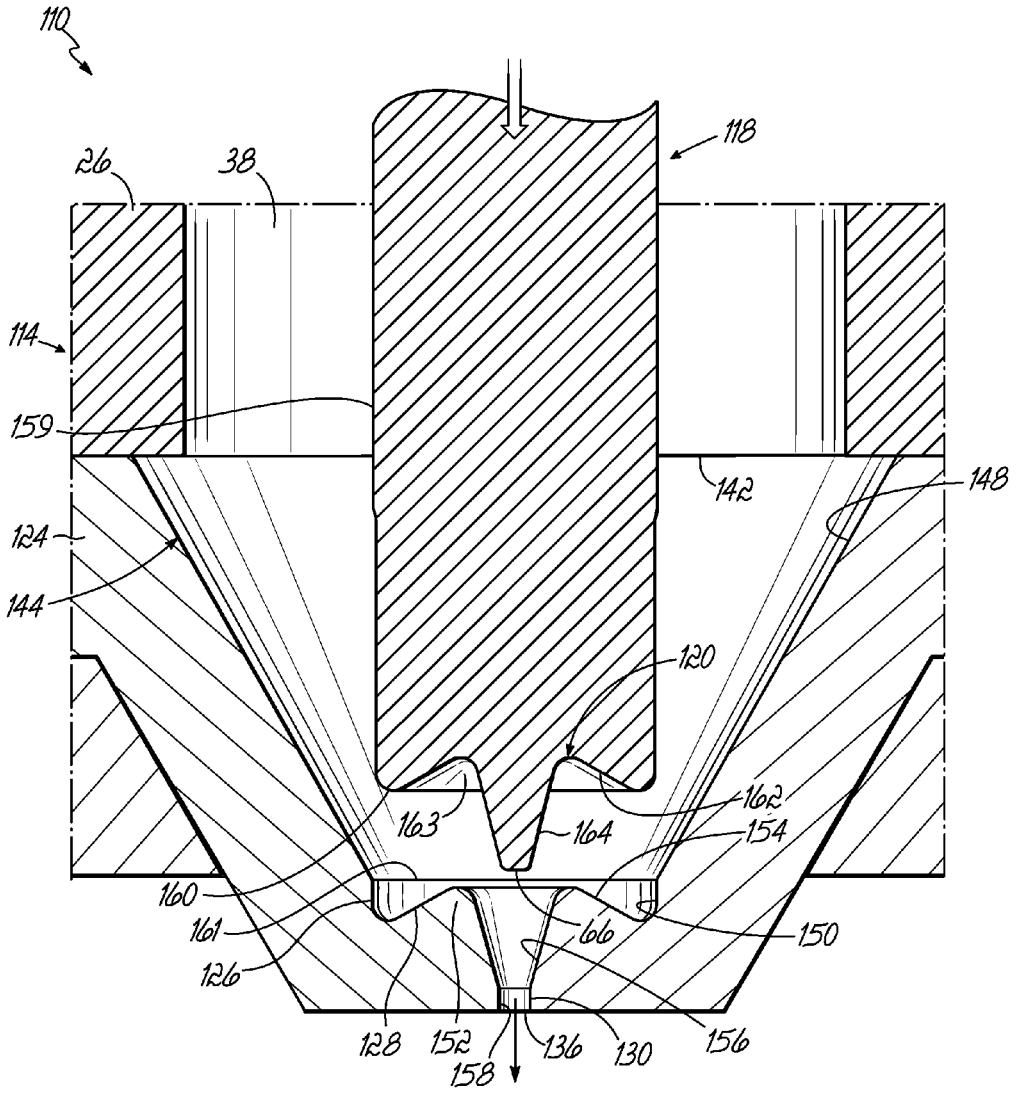
FIG. 3A is an enlarged sectional view of an alternative embodiment of a dispensing module having a valve element in a proximal position constructed in accordance with the invention.
Figure 3B:
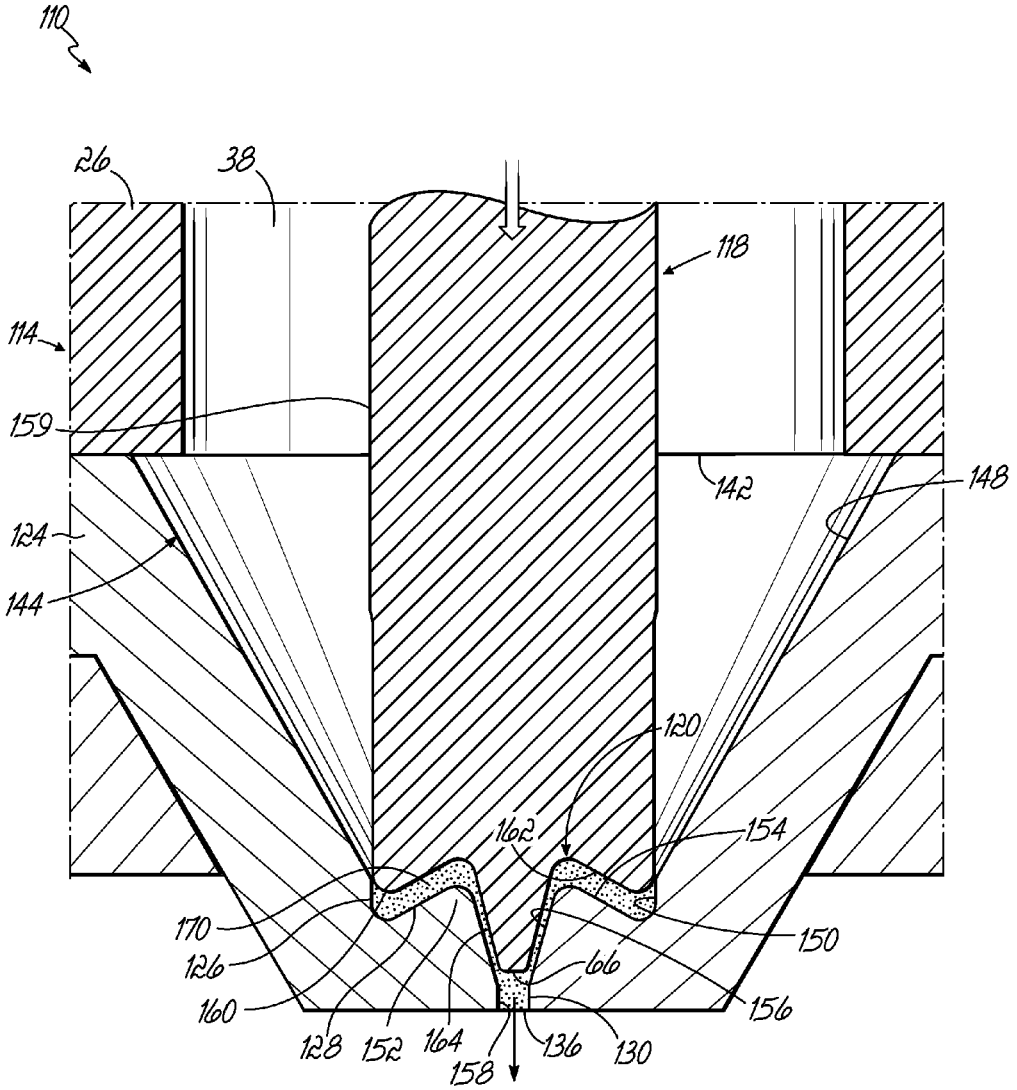
FIG. 3B is similar to FIG. 3A, but shows the valve element in a medial closed.
Figure 3C:
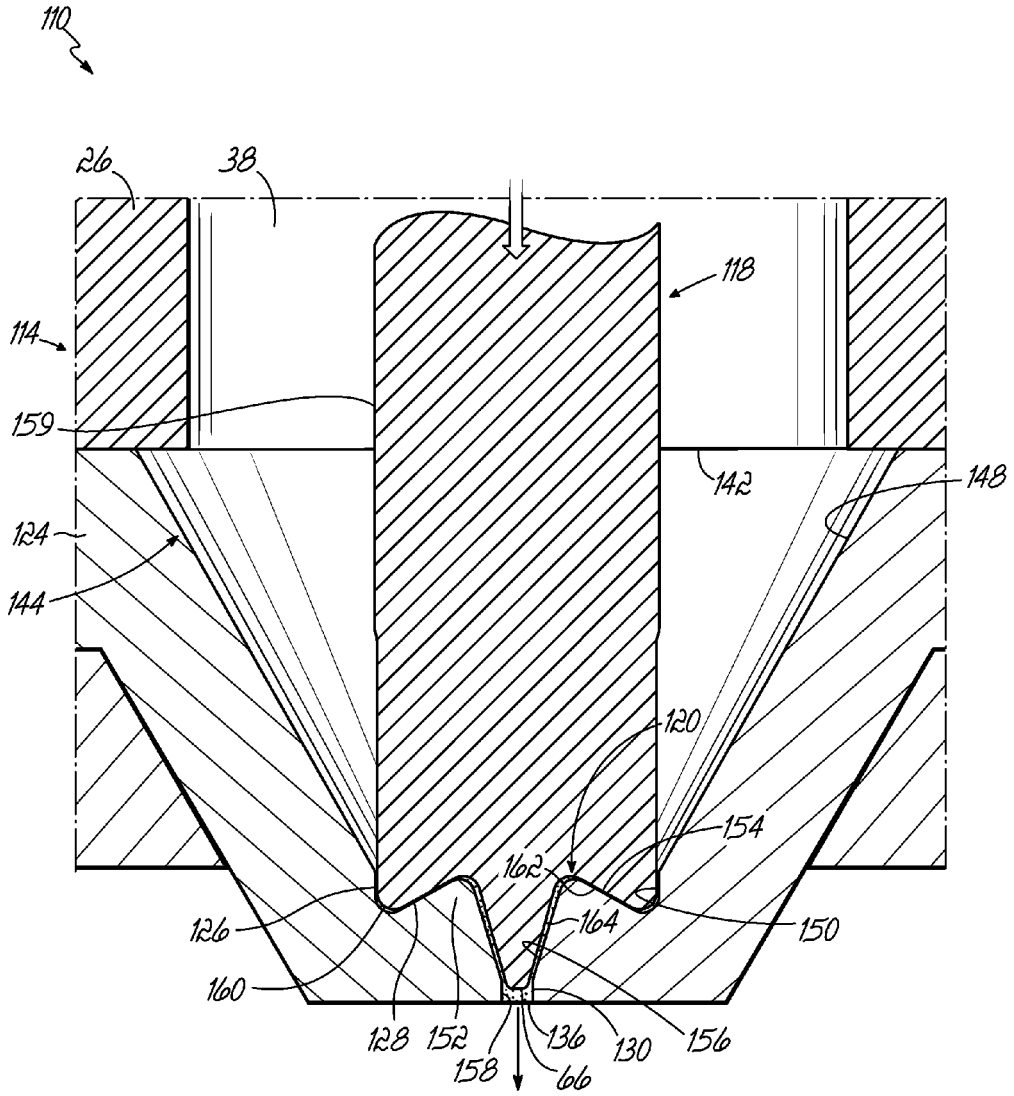
FIG. 3C is similar to FIG. 3B, but shows the valve element in the distal closed position.

With respect to FIGS. 3A-3C, an alternative embodiment of a dispensing module 110 includes the dispenser body 12 having a needle 118 moveably mounted within the bore 16 (see FIG. 1). Also, a nozzle 114 is connected to the dispenser body 12 for dispensing an adhesive, or other viscous liquid. In this respect, like numbers indicate like features described above.

As shown in FIG. 3A, the needle 118 is an elongated shaft having a needle tip 120 proximate to the nozzle 114. As describe above, the needle 118 reciprocates within the dispenser body 12 between the proximal open position and the distal closed position. The nozzle 114 includes the nozzle body 22 and a nozzle insert 124 positioned within the nozzle body 22 that carries a sealing zone 126 and valve seat 128.

The liquid supply passage 38 fluidly connects to an inlet 142 of a liquid passageway 144 within the nozzle 114. Accordingly, liquid adhesive flows through the liquid supply passage 38, the liquid passageway 144, and a discharge passageway 130, to be dispensed from the outlet 136 when the needle 118 is disengaged from valve seat 128. The nozzle 114 and the needle 118 collectively provide a dispensing valve for controlling the flow of adhesive from the outlet 136.

More particularly, the liquid passageway 144 is defined by the nozzle insert 124 including a proximal bore 148 defining the inlet 142 that extends to a sealing cylindrical surface 150. According to an exemplary embodiment, the bore 148 is in the form of a first converging surface, such as a first frustoconical surface. In turn, the sealing cylindrical surface 150 extends to a shoulder 152 carrying the valve seat 128. The shoulder 152 has a raised annular projection 154 tapering proximally toward the inlet 142. The valve seat 128 is further defined by an intersection between the shoulder 152 and a distal, second converging surface 156. More particularly, the second converging surface 156 is in the form of a second frustoconical surface. Accordingly, the valve seat 128 provides a smooth circumferential surface that defines a circular surface of contact with the needle tip 120. As described above, it will be appreciated that the term "circular line of contact" may refer to a circular line of generally any width. According to an exemplary embodiment, the smooth circumferential edge defines a relatively thick circular line of contact.

The valve seat 128 is centered or coaxial with, and radially symmetric relative to the longitudinally extending needle 118 within the liquid passageway 144. The second converging surface 156 extends to the discharge passageway 130. In addition, the bore 148 and the second converging surface 156 and second cylindrical surface 158 taper and extend respectively similar to those discussed above.

The needle 118 includes the cylindrical valve surface 159 extending to the needle tip 120. An intersection of the cylindrical valve surface 159 and the needle tip 120 define a valve leading edge 160, whereas an intersection of the sealing cylindrical surface 150 and the bore 148 define a nozzle leading edge 161. The sealing cylindrical surface 150 of the liquid passageway 144 defines a sealing diameter sized to provide a sealing engagement with the cylindrical valve surface 159. As such, the valve leading edge 160 makes initial engagement with the nozzle leading edge 161 to define a first volume 170 (see FIG. 3B) of the liquid passageway 144 closed from the inlet 142.

Furthermore, the needle tip 120 includes a first frustoconical valve surface 162 and a second frustoconical valve surface 164. The first frustoconical valve surface 162 tapers toward the inlet 142 to define an annular converging groove 163 about the needle tip 120. The annular converging groove 163 is configured for sealing against the circular surface of the raised annular projection 154. As such, a circumferential portion of the first frustoconical valve surface 162 contacts the valve seat 128 to create the circular surface of contact, which provides a sealing engagement in the distal closed position that defines a second volume 172 (see FIG. 3C) of the liquid passageway 144 closed from the inlet 142.

The second frustoconical valve surface 164 tapers conically toward the apex 66 with a first included angle. The taper angle of the second converging surface 156 of the liquid passageway 144 is greater than or equal to the second included angle of the second frustoconical valve surface 164 such that a volume of a cavity 68 defined therebetween is reduced to minimize residual adhesive within the cavity 68. Also, at least a portion of the second frustoconical valve surface 164 and the apex 66 extend into the discharge passageway 130, proximate to the outlet 136, to inhibit clogging of adhesive in the distal closed position.

With respect to FIG. 3B, the needle 118, while moving from the proximal open position toward the distal closed position, moves into a medial closed position in which the first volume 170 of the liquid passageway 144 is closed from the inlet 142. The first volume 170 is represented in FIG. 3B by a first remaining volume of adhesive located within the liquid passageway 144 distal of the alignment between the valve leading edge 160 and the nozzle leading edge 161. Of course, as shown in FIG. 3C, the needle 118 continues to move to the distal closed position where the second frustoconical valve surface 164 engages the valve seat 128. The second volume 172 is represented in FIG. 3C by a second remaining volume of adhesive located within the liquid passageway 144 distal of the valve leading edge 160 engaged against the sealing cylindrical surface 150.

The valve leading edge 160 moves distally beyond the nozzle leading edge 161 along the sealing cylindrical surface 150 as the needle 118 moves from the medial closed position to the distal closed position. Accordingly, the distance along the sealing cylindrical surface 150 that the valve leading edge 160 travels, defines the sealing zone 126 along generally an entirety of the sealing cylindrical surface 150 with the seal diameter. As the valve leading edge 160 moves distally along the sealing zone 126, the first volume 170 gradually reduces to the second volume 172 and the needle 118 positively displaces a differential volume of adhesive from the liquid passageway 144.

With reference to FIGS. 1-2C, 4, and 7, the dispensing module 10 operatively pressurizes an adhesive with the needle 18 in the proximal open position so that the liquid passageway 44 is open and generally unobstructed by the needle 18. The pressurized adhesive is in turn forced through the inlet 42, along the liquid passageway 44, and from the outlet 36 to discharge a first bead portion 78. The needle 18 moves from the proximal open position toward the distal closed position until reaching the medial closed position where the valve leading edge 60 aligns with the nozzle leading edge 61 of the sealing zone 26 to close the first volume 70 of the liquid passageway 44 from the inlet 42. Once the nozzle leading edge 61 engages the sealing zone 26, the pressurized adhesive flow ceases to discharge.

From the medial closed position, the needle 18 continues moving distally along the sealing zone 26 toward the distal closed position. While moving along the sealing zone 26, the first volume 70 of the liquid passageway 44 gradually reduces to the second volume 72 of the liquid passageway 44 in the distal closed position. In turn, the needle 18 positively displaces the adhesive remaining in the liquid passageway 44 and discharges the differential volume of adhesive as a second bead portion 80.

Figure 7:
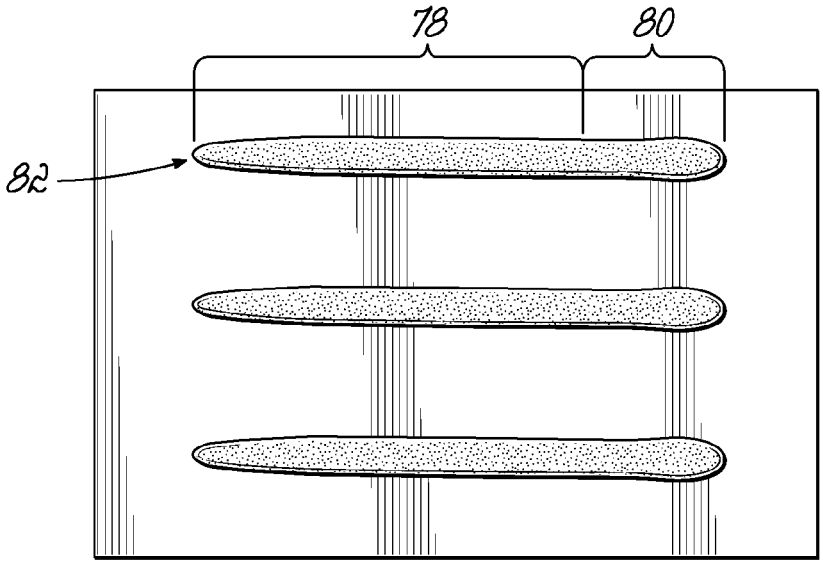
FIG. 7 is an exemplary bead of adhesive on a receiving surface dispensed by a dispensing module in accordance with the invention.

Furthermore, as the needle 18 approaches the valve seat 28, at least a portion of the needle tip 20 inserts into the discharge passageway 30 to inhibit adhesive clogging proximate to the outlet 36. According to an exemplary embodiment, the discharge passageway 30 and needle tip 20 define the cavity 68 therebetween that contains a final remaining portion of adhesive. While the approaching needle tip 20 partially obstructs the discharge passageway 30, the positive displacement of the adhesive forces the adhesive around the needle tip 20 and through the outlet 36 with sufficient consistency to generate a desirable bead 82 of adhesive as shown in FIG. 7. Of course, once the desirable bead 82 is generated, the needle 18 moves proximally from the valve seat 28 to the proximal open position to repeat the above description for additional beads.

Figure 4:
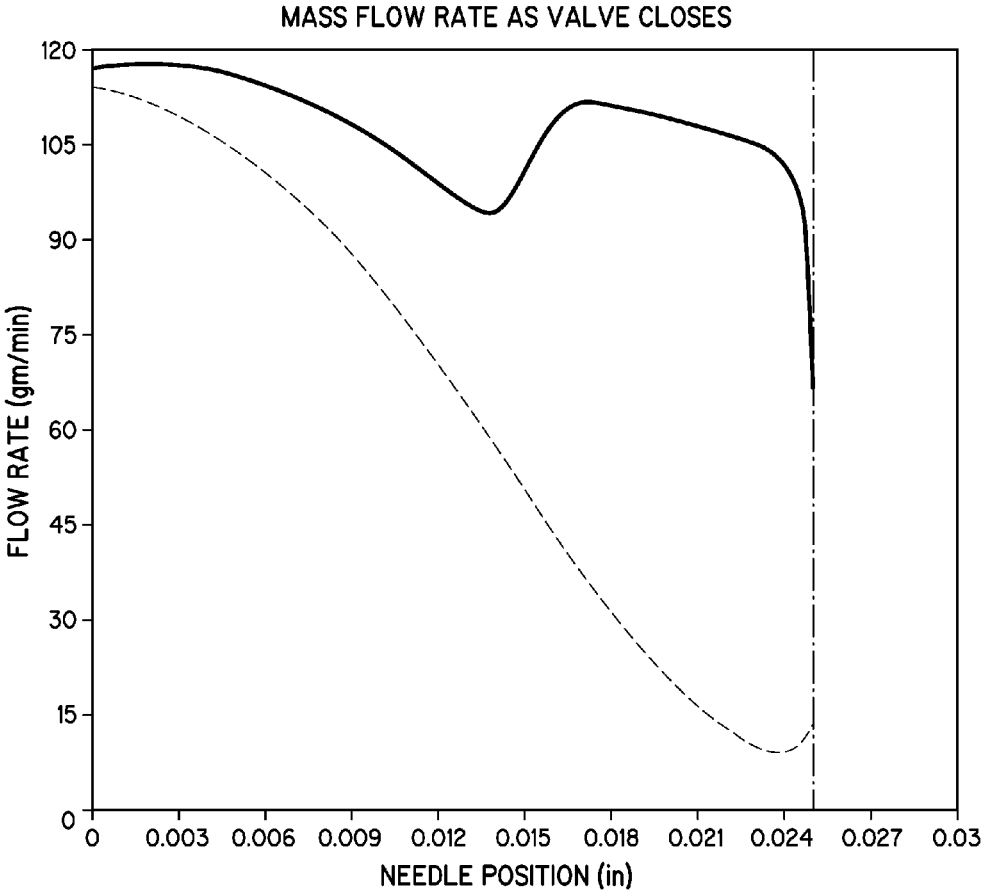
FIG. 4 is a chart illustrating an exemplary mass flow rate of a prior art dispensing module and an exemplary mass flow rate of the embodiment of the dispensing module shown in FIGS. 2A-2C.
Figure 5:
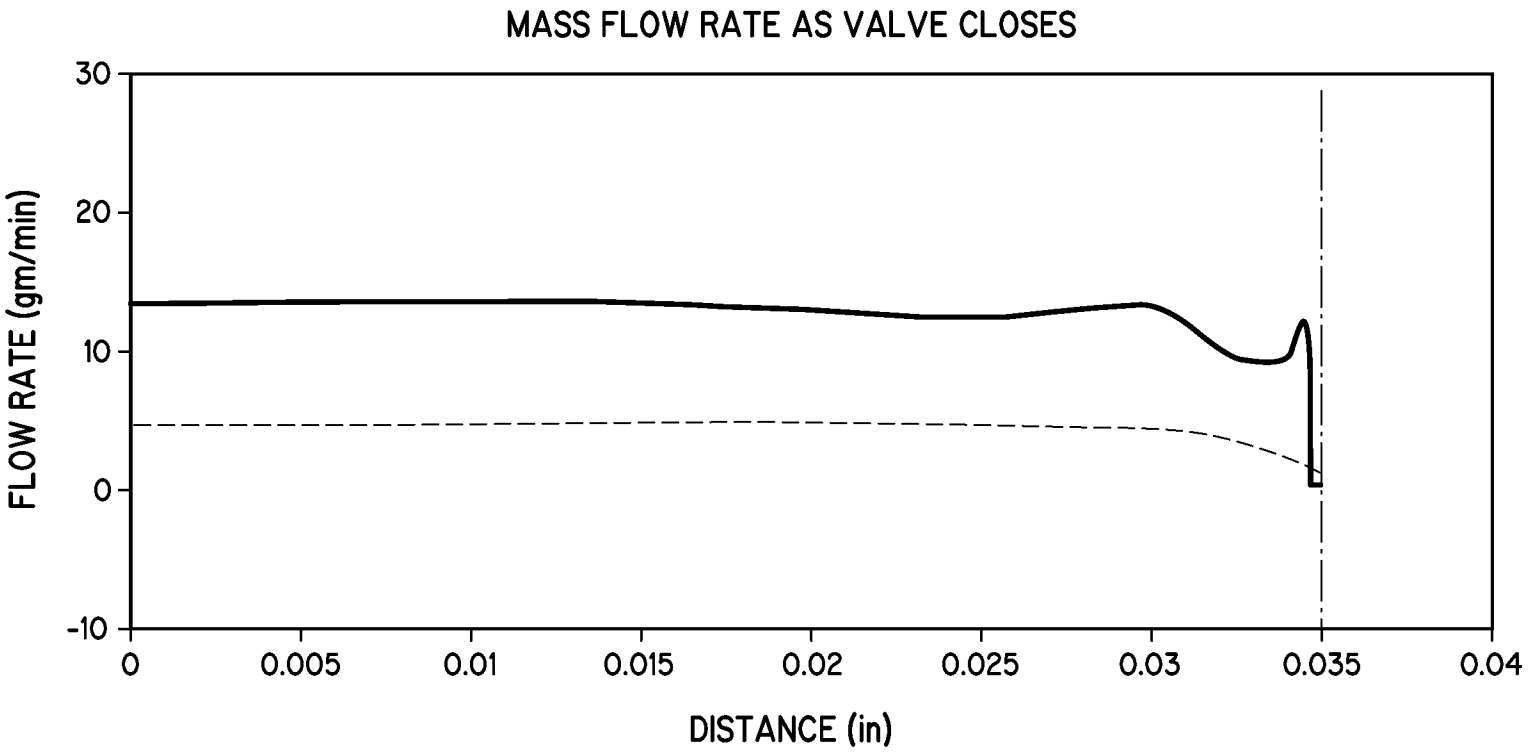
FIG. 5 is a chart illustrating an exemplary mass flow rate of a prior art dispensing module and an exemplary mass flow rate of the alternative embodiment of the dispensing module shown in FIGS. 3A-3C.
Figure 6:
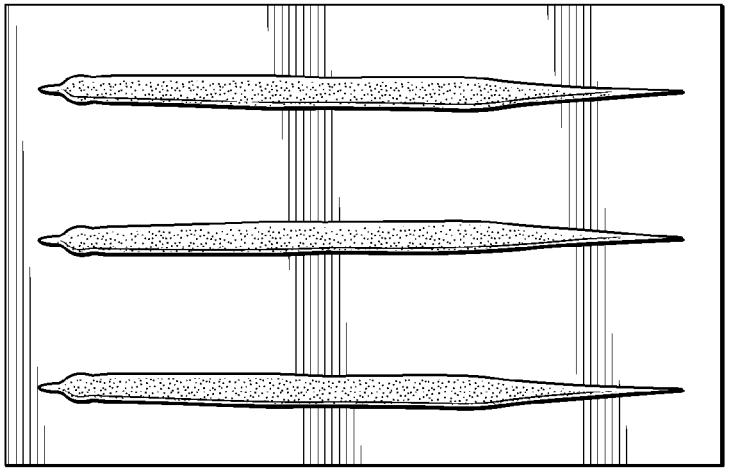
PRIOR ART FIG. 6
FIG. 6 is an exemplary bead of adhesive on a receiving surface dispensed by a prior art dispensing module.

While the above description refers to the dispensing module 10 for dispensing the adhesive, the dispensing module 110 shown in FIGS. 3A-3C may be similarly used for dispensing the adhesive. For example, both FIG. 4 and FIG. 5 show test results for mass flow rates of the adhesive discharging in accordance with the dispensing modules 10, 110, respectively. With respect to FIG. 4 and FIG. 7, the dashed line represents a dispensing module of the prior art discharging an adhesive with a needle moving at 20 inches per second. Notably, as the prior art needle moves from the proximal open position at 0 inches toward the distal closed position at 0.025 inches, the flow rate of the adhesive gradually decreases and results in the undesirable tailing effect shown in FIG. 6. In contrast, FIG. 4 shows the solid line representing a dispensing module 10 with the needle 18 moving at 20 inches per second discharging the first bead portion 78, as shown in FIG. 7, from the proximal open position to the medial closed position at approximately 0.014 inches. Thus, the needle 18 positively displaces the second bead portion 80 from the medial closed position to the distal closed position, at which point, the second bead portion 80 rapidly cuts off.

With respect to FIG. 5 and FIG. 7, the dashed line represents a dispensing module of the prior art discharging an adhesive with a needle moving at 30 inches per second. Similar to the above description, as the prior art needle moves from the proximal open position at 0 inches toward the distal closed position at 0.035 inches, the flow rate of the adhesive gradually decreases from 0.03 inches to the distal closed position and also results in the undesirable tailing effect shown in FIG. 6. In contrast, FIG. 5 shows the solid line representing a dispensing module 110 with the needle 18 moving at 30 inches per second discharging the first bead portion 78, as shown in FIG. 7, from the proximal open position to the medial closed position at approximately 0.03 inches. Thus, the needle 18 positively displaces the second bead portion 80 from the medial closed position to the distal closed position, at which point, the second bead portion 80 rapidly cuts off.

While the present invention has been illustrated by the description of one or more embodiments thereof, and while the embodiments have been described in considerable detail, they are not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method and illustrative examples shown and described. Accordingly, departures may be from such details without departing from the scope of the general inventive concept.

What is claimed is:

1. A method of dispensing an adhesive bead from a dispensing module comprising a dispenser body and a nozzle, the dispenser body comprising a valve element being movable from a proximal position to a distal position, and the nozzle including an inlet, an outlet, and a liquid passageway extending therebetween, the method comprising:

moving the valve element from the proximal position to a sealing zone to close a first volume of the liquid passageway from the inlet to cease discharge of a first portion of the adhesive bead;

moving the valve element distally along the sealing zone toward the distal position to reduce the first volume of the liquid passageway to force additional adhesive from the outlet and discharge a second portion of the adhesive bead;

engaging the valve element against a valve seat in the distal position to close a second volume of the liquid passageway to cease discharge of a second portion of the adhesive bead; and inserting at least a portion of a needle tip of the valve element into a discharge passageway that defines the outlet to inhibit clogging of the adhesive within the nozzle.

2. The method of claim 1, further comprising:

forcing pressurized adhesive from the outlet with the valve element in the proximal position to discharge the first portion of the adhesive bead.

3. The method of claim 1, wherein the needle tip of the valve element is in the distal position and the discharge passageway defines a cavity therebetween, and the method further comprises:

maintaining a remaining portion of the adhesive within the cavity after discharging the second portion of the adhesive bead.

4. The method of claim 1, further comprising:

moving the valve element proximally from the sealing zone to the proximal position to discharge a first portion of another adhesive bead following insertion of at least the portion of the needle tip of the valve element into the discharge passageway that defines the outlet.

5. The method of claim 1, further comprising:

supplying adhesive from a liquid supply passage of the dispenser body to the inlet of the nozzle.

6. The method of claim 1, wherein the nozzle is distal of the dispenser body and configured to mate with the dispenser body.

7. The method of claim 1, wherein:

the needle tip defines a valve leading edge;

the nozzle defines a nozzle leading edge at a proximal end of the sealing zone; and moving the valve element from the proximal position to the sealing zone to close a first volume of the liquid passageway from the inlet to cease discharge of a first portion of the adhesive bead comprises distally moving the valve element so that the valve leading edge contacts the nozzle leading edge to close a first volume of the liquid passageway from the inlet to cease discharge of a first portion of the adhesive bead.

8. The method of claim 7, wherein the valve leading edge and the nozzle leading edge have substantially the same diameter.

9. The method of claim 7, wherein the sealing zone axially extends from the nozzle leading edge to the valve seat.

10. The method of claim 7, wherein the sealing zone has the same diameter from the nozzle leading edge to the valve seat such that the first volume of the liquid passageway remain closed from the inlet as the valve element is moved distally along the sealing zone toward the distal position.

11. The method of claim 1, wherein the needle tip comprises a frustoconical surface that is partially inserted into the discharge passageway that defines the outlet.

12. The method of claim 11, wherein the needle tip comprises a first frustoconical surface and a second frustoconical surface that axially overlaps with the first frustoconical surface.

13. The method of claim 11, wherein the needle tip comprises a first frustoconical surface and a second frustoconical surface distal of the first frustoconical surface.

14. The method of claim 13, wherein the second frustoconical surface is partially inserted into the discharge passageway that defines the outlet while the first frustoconical surface engages against the valve seat.

* * * * *